US010907421B2

(12) United States Patent
Creighton et al.

(10) Patent No.: US 10,907,421 B2
(45) **Date of Patent: *Feb. 2, 2021**

(54) DRILL STRING APPLICATIONS TOOL

(71) Applicant: TELEDRILL, Inc., Katy, TX (US)

(72) Inventors: Ford Douglas Creighton, Houston, TX (US); Gabor Vecseri, Houston, TX (US); Robert MacDonald, Houston, TX (US)

(73) Assignee: Teledrill Inc, Katy, TX (US)

( * ) Notice: Subject to any disclaimer, the term of this patent is extended or adjusted under 35 U.S.C. 154(b) by 129 days.

This patent is subject to a terminal disclaimer.

(21) Appl. No.: 15/908,028

(22) Filed: Feb. 28, 2018

(65) Prior Publication Data

US 2018/0320459 A1 Nov. 8, 2018

Related U.S. Application Data

(60) Continuation-in-part of application No. 15/721,083, filed on Sep. 29, 2017, which is a continuation-in-part (Continued)

(51) Int. Cl.
*E21B 17/20* (2006.01)
*E21B 47/24* (2012.01)

(Continued)

(52) U.S. Cl.
CPC ..... *E21B 17/20* (2013.01); *E21B 47/24* (2020.05); *E21B 47/12* (2013.01); *E21B 47/14* (2013.01); *E21B 47/18* (2013.01)

(58) Field of Classification Search
CPC ..... E21B 47/12; E21B 47/14; E21B 47/18; E21B 47/182; E21B 47/185;

(Continued)

(56) References Cited

U.S. PATENT DOCUMENTS 6,607,030 B2 8/2003 Bauer et al.
8,162,078 B2 4/2012 Anderson (Continued)

FOREIGN PATENT DOCUMENTS

CA 2780885 C 1/2014
RU 2574651 C1 2/2016
RU 2586122 C2 6/2016

OTHER PUBLICATIONS

CT Energy Services, "The Toe Tapper. Negative Pressure Pulse, Friction Reduction Tool". http://www.ctenergyservices.com/products/drilling-toe-tapper/toe-tapper/.

(Continued)

*Primary Examiner* — Franklin D Balseca
(74) *Attorney, Agent, or Firm* — ePatentManager.com; Guerry L. Grune

(57) ABSTRACT

An apparatus and system for generating pressure pulses for enhancing and completing a well bore within a pipe or coiled tubing operation including: a valve longitudinally and axially positioned within the center of a pulser section, a gearbox, and an impeller. The main fluid flow is interrupted by the main valve which is operated by a controlled pilot fluid stream. The pilot fluid stream is controlled by a determined rotation of a gearbox driven by an impeller located centrally and axially and connected to the gearbox. Most specifically, the system utilizes pulse technology to improve weight transfer in horizontal wells by modulating flow, pressure and weight on the bit. The system can be used to overcome coiled tubing (CT) drill out challenges by overcoming friction forces that impede the downhole reach.

27 Claims, 5 Drawing Sheets

Related U.S. Application Data of application No. 15/465,814, filed on Mar. 22, 2017, which is a division of application No. 14/255,763, filed on Apr. 17, 2014, now Pat. No. 9,702,204.

(51) Int. Cl.
*E21B 47/12* (2012.01)
*E21B 47/14* (2006.01)
*E21B 47/18* (2012.01)

(58) Field of Classification Search
CPC ..... E21B 47/187; E21B 17/20; E21B 47/20; E21B 47/22; E21B 47/24
See application file for complete search history.

(56) References Cited

U.S. PATENT DOCUMENTS

| | | | | |
|---|---|---|---|---|
| 9,133,664 | B2 * | 9/2015 | MacDonald | E21B 47/18 |
| 9,222,312 | B2 | 12/2015 | Anderson | |
| 9,702,204 | B2 * | 7/2017 | MacDonald | E21B 44/00 |
| 9,958,849 | B2 * | 5/2018 | Degrange | E21B 47/124 |
| 2013/0048379 | A1 | 2/2013 | MacDonald et al. | |
| 2019/0100994 | A1 * | 4/2019 | Vecseri | E21B 47/187 |

OTHER PUBLICATIONS

PCT International Search Report for PCT/US2019/019723. ISA/RU, dated Jun. 6, 2019.

* cited by examiner

DRILL STRING APPLICATIONS TOOL

PRIORITY

This application is a continuation-in-part of and claims priority under 35 USC 120 to U.S. patent application Ser. No. 15/721,083 filed Sep. 29, 2017 entitled "Coiled Tubing Applications and Measurement Tool" which is a continuation-in-part of and claims priority to Ser. No. 15/465,814 filed Mar. 22, 2017 which is a divisional of and claims priority to U.S. patent application Ser. No. 14/255,763 filed Apr. 17, 2014, and granted as U.S. Pat. No. 9,702,204 on Jul. 11, 2017, both entitled "Controlled Pressure Pulser for Coiled Tubing Measurement While Drilling Applications".

FIELD OF DISCLOSURE

Pulses produced by the pulser create momentary axial loads on the bottom-hole assembly (BHA) and along the coiled-tubing string, workover string, or drill string (All three types of strings will further be denoted as the "string"), thus reducing friction, pulling the string, and enhancing extended reach (ER) within the wellbore.

The current invention includes a downhole application improvement tool that enhances string operations and includes an impeller herein referred to as "the Tool" that can be used in string operations including but not limited to intervention and completion. The Tool creates controlled pulses within the drilling fluid or drilling mud that travels along the internal portion of the string.

BACKGROUND

This invention relates to new and improved methods and devices for completion, deepening, fracturing, fishing, cleanout, reentering and plug milling of the wellbore. This invention finds particular utility in the completion of horizontal wells. Notwithstanding previous attempts at obtaining cost-effective and workable horizontal-well completions, there continues to be a need for increasing horizontal well departure to increase, for example, unconventional shale plays—which are wells exhibiting low permeability and therefore requiring horizontal laterals increasing in length to maximize reservoir contact. With increased lateral length, the number of zones fractured increases proportionally.

Most of these wells are fractured using the "Plug and Perf" method which requires perforating the stage nearest the toe of the horizontal section, fracturing that stage and then placing a composite plug followed by perforating the next stage. The process is repeated numerous times until all the required zones are stimulated. Upon completing the fracturing operation, the plugs are removed with a mill/bit on the end of a down-hole impeller that is connected to the string. As the lateral length increases, milling becomes less efficient, leading to the use of jointed pipe for removing plugs.

Two related reasons cause this reduction in efficiency. First, as the depth increases, the effective maximum weight on bit (WOB) decreases. Second, at increased lateral depths, the coiled tubing is typically in a stable helical spiral in the wellbore. The operator sending the additional string (and weight from the surface) will have to overcome greater static loads leading to a longer and inconsistent transmission of load to the bit. The onset of these two effects is controlled by several factors including; pipe wall thickness, wellbore deviation and build angle, completion size, pipe/casing contact friction drag, fluid drag, debris, and bottom hole assembly (BHA) weight and size. Pipe or tubing with an outer diameter less than 4 inches tends to buckle due to easier helical spiraling, thus increasing the friction caused by increased contact surface area along the wall of the bore hole. Outer diameters greater than 4 inches are impractical due to weight and friction limitations. Friction drag is a function of pipe wall thickness and diameter, leaving end loads as one of the variables most studied for manipulation to achieve better well completion.

In fracturing applications, milling out frac-plugs with coiled tubing can be challenging, especially in longer laterals. Vibration or water hammer type of extended reach (ER) tools included in the BHA can extend the coiled tubing unit's reach to the deepest plugs, but well-site operators still encounter slow drilling, motor stalls, debris build-up and coil lock up, which can cause delays and require frequent short trips.

Horizontal wellbores around the world are getting longer, leading to more demand for these extended-reach (ER) tools. A more powerful mechanical agitation feature is needed to carry coiled-tubing strings to deeper total depth (TD). In coil-frac applications, TDs are reached without the need to pump down annulus with frac pumps, which is operationally complex, and could inadvertently shift a frac sleeve.

The present disclosure relates to a tool that provides for extended lateral reach due to reduced friction forces as well as improved weight transfer to the BHA (bottom hole assembly).

Improved weight transfer is a cost-effective solution for these operations. A reduced number of trips down hole also translate into reduced fatigue of the coil string and extension for further reach.

Coiled tubing string replacement is one of the highest costs for CT operators in unconventional well completions. Because coil life is a function of its reeling and unreeling, excessive coil movement can create premature fatigue and shorten the life of the coil. The tool described herein enables drill-outs and hole-cleaning with a minimum number of short trips, extending coil life and saving money for CT providers and of course associated oil company operators.

Pulsing technology incorporated within the tool acts to reduce friction along the length of the coil while also providing axial pull at the end of the string, in excess of several thousand pounds.

SUMMARY

The need to effectively overcome these challenges regarding lateral reach has led to the development of the tool and associated devices of the present disclosure. This tool allows for improved methods that provide better well completions, achieving extended reach, better rate and direction of penetration with proper WOB (weight on bit).

Current pulser technology utilizes pulsers that are sensitive to different fluid properties, downhole pressures, and flow rates, and requires field adjustments to pulse properly. Newer technology incorporated includes the use of water hammer devices producing a force when the drilling fluid is suddenly stopped or interrupted by the sudden closing of a valve. This axial force created by the sudden closing and opening of the valve can be used to pull the coiled tubing deeper into the wellbore. The pull into the wellbore is increased by the axial stress in the coiled tubing and straightening the tubing due to momentary higher fluid pressure inside the tubing and thus reducing the frictional drag. This task—generating the force by opening and closing valves— can be accomplished in many ways—and is also the partial subject of the present disclosure.

The present disclosure and associated embodiments allow for providing a pulser system within string such that the pulse amplitude increases with flow rate or overall fluid pressure within easily achievable limits, does not require field adjustment, and is capable of creating recognizable, repeatable, reproducible, fluid pulse signals using minimum power due to unique design features. The tool utilizes turbine or impeller generated energy to provide controlled rate of penetration (ROP) capabilities, extended reach (ER) and axial agitation within the string using the tool of the present disclosure.

As indicated above, the coiled tubing industry continues to be one of the fastest growing segments of the oilfield services sector, and for good reason. Growth has been driven by attractive economics, continual advances in technology, and utilization of a drill string to perform an ever-growing list of field operations. The economic advantages of the present invention include; pulse with as much amplitude as required, extended reach of the string to the end of the run, allowing for reduction of time on the well and more efficient well production, reduced coiled tubing fatigue by eliminating or reducing string cycling (insertion and removal of the coil tubing string from the well), high pressure pulses with little or no kinking and less friction as the pulses are at least partially controlled in this manner.

More specifically, an apparatus for generating pressure pulses in a drilling fluid that is flowing, enhancing, and completing a well bore within a coiled tubing assembly comprises: a valve longitudinally and axially positioned within the center of a main valve assembly including a main valve wherein the main valve assembly also comprises a main valve pressure chamber, and a main valve orifice with a main valve, such that the drilling fluid splits into both an inlet main fluid stream and a pilot fluid stream. The pilot fluid stream flows through a pilot flow annulus, and into a pilot inlet port, wherein the pilot fluid then flows past the pilot inlet cam behind the main valve activating the main valve. The pilot fluid flows out through a pilot outlet and recombines with a main flow then passes around a drive coupling mechanism toward an impeller enabling the pulser to generate controllable, large, rapid pulses.

Here the upper and lower rotary seals exist within an oil filled pressure chamber and act to separate the pilot fluid above or in front of the upper rotary seal from a portion exposed to atmospheric pressure that exists below or behind the lower rotary seal so that a drive coupling, and gearbox, below the upper and lower rotary seals prevent pilot fluid stream from entering and damaging the gearbox.

Further, the pilot shaft is rotated by an impeller that converts the linear fluid flow through the tool into rotational motion, which is transferred from the impeller to the gearbox via the impeller shaft. The gearbox which is connected to the drive coupling, and secured from rotation by antirotation pins, and wherein the pilot inlet cam and the pilot outlet cam are positioned on the shaft so that both cams can rotate and so that when the pilot inlet cam is in an open position it allows the pilot fluid to enter the main valve and simultaneously the pilot outlet cam maintains a closed position that prevents the pilot fluid to exit through a reverse flow check valve.

The reverse flow check valve allows the pilot fluid stream to escape from within the pilot housing in normal operation but prevents fluid flow in opposite, reversed flow direction from the outside of the pilot housing to behind the main valve.

The resultant reverse fluid flow does not cause pulsing of fluid while operation of pulsing mode exists during a forward flow condition.

Further, the frequency of opening and closing of a pilot inlet cam and a pilot outlet cam directly influences and determines one or more frequencies of the main valve opening and closing to create pressure pulses in a main fluid column above or in front of the main valve orifice. The impeller, through the gearbox, rotates the pilot shaft to position the pilot inlet cam to open and closed positions and wherein when the pilot inlet cam is a closed position the pilot outlet cam is in an open position the pilot fluid behind or below the main valve to allowed escape through the reverse flow check valve and to join the main fluid flow.

The reverse flow check valve allows pilot fluid o exit the main valve so that the main valve can return to a rear or open position with respect to the main valve orifice.

The present disclosure also provides for a system that generates pressure pulses in a drilling fluid within a well bore that exists within a coiled tubing assembly, the system comprising: a tool within which exists a valve portion longitudinally and axially positioned within a center portion of a main valve assembly, the assembly including a main valve, a main valve pressure chamber, and a main valve orifice with the main valve, such that as the drilling fluid flows downward in the string into the Tool the drilling fluid splits into both an inlet main fluid stream and a pilot fluid stream, wherein the pilot fluid stream flows through a pilot flow annulus and into a pilot inlet port, wherein the pilot fluid stream then flows into a main valve fluid feed channel until it reaches the main valve pressure chamber and through a pilot valve section that functions as a pulser generating portion of the tool that further comprises a pilot valve housing, a pilot shaft positioned in a central axial position within the tool supported by thrust bearings, a seal carrier, upper and lower rotary seals, and a pilot inlet cam and a pilot outlet cam such that the pilot shaft can rotate said pilot inlet cam and pilot outlet cam inside a pilot sleeve with matching orifices so that the pilot fluid stream is controlled by movement of the pilot inlet cam and the pilot outlet cam and wherein the pilot fluid flows into and through a pilot flow outlet channel such that the pilot fluid recombines with a main fluid flow to become a main exit fluid flow.

In an additional embodiment, a pilot valve actuator assembly is provided. The pilot valve assembly is any one or more from the group consisting of; a pilot valve housing, a pilot shaft, rotary seals, a seal carrier, pilot cams, a pilot sleeve, oil chamber, thrust bearings and reverse flow check valve. Thrust bearings allow for the reduction of friction from the impeller shaft.

Further, an impeller and impeller shaft are connected to the pilot shaft that has pilot cams attached to the shaft and rotate the pilot cams. The pilot cams are sized and oriented within the pilot sleeve in order to allow for the pilot shaft to move in a rotary motion in order to seal or open pilot outlet or pilot inlet port.

Rotational motion of an impeller connected to a rotating pilot shaft that is connected to and moves the pilot cams, causes channeling of the pilot fluid toward the main valve. This channeling of the fluid causes the main valve to close and also allows for the pilot fluid to move the main valve. Consequently, the pilot valve cams are sized and shaped in such a way that part of their rotation blocks channeling of the pilot fluid toward the main valve. This cessation of fluid flow causes the main valve to open and also allows for the pilot fluid to move out of the main valve.

In this case, the apparatus generates fluid pulses such that the Tool using the pilot shaft rotation provides unidirectional rotary movement of the pilot shaft within the pilot valve housing.

Further, the apparatus provides a flow path allowing flow of the pilot fluid through the pilot valve that channels the pilot fluid toward the main valve resulting in operation of the main valve bi-directionally along the moving axis.

In an additional embodiment, differential pressure is maximized by using a flow cone in the main valve section. The flow cone provides for increasing the velocity of the drilling fluid through the orifice of the main valve section. This increase in velocity causes an increase in the pressure differential and also allows for utilization and better control of the energy pulses created by opening and closing of the main valve by using the pilot valve.

In case of no fluid flow rotating the impeller and the connected pilot cams diverting the pilot fluid to control the main valve, to avoid the main valve to be in a closed stopped position a safety mechanism prevents the main valve from staying in a closed position allowing the main fluid flow to start up rotating the impeller.

The tool includes three modular sections which when combined provide a downhole tool which measures from 1-3 feet in length depending on what main valve, pilot valve, and impellers are in the configuration, with an outside diameter of at least 1 and 11/16 inches.

The tool is made up in the BHA above the down-hole PDM motor during plug milling operations, allowing ball drop-activated tools above the tool to be operated in the normal fashion.

Pulses can be reliably transmitted in coil tubing strings over 30,000 ft.

In annular frac applications, the tool provides reverse circulation capability in the event of a screen-out. A "screen-out" is when the fracing propellant clogs the perforation holes causing increased pump pressure. The operation is thus stopped in order to clean the well bore. A reverse flow check valve prevents the pilot valve actuating the main valve in case the flow in the string is reversed. The down-hole tool is compliant with the use of hydrochloric (HCl) and hydrofluoric (HF) acids.

In a further embodiment, the tool can be used without a reverse flow check valve, where the reverse flow check valve is to be replaced with a plug.

A further additional embodiment includes the use of the Tool without the pilot outlet cam.

The present disclosure and associate inventiveness can be described as a system that utilizes pulse technology to improve weight transfer in horizontal wells by modulating flow, pressure and weight on the bit. The system can be used to overcome coiled tubing (CT) drill out challenges by overcoming friction forces that impede the downhole reach.

DETAILED DESCRIPTION OF DRAWINGS

The present disclosure and associated invention will now be described in greater detail and with reference to the accompanying drawings.

Figure 1:
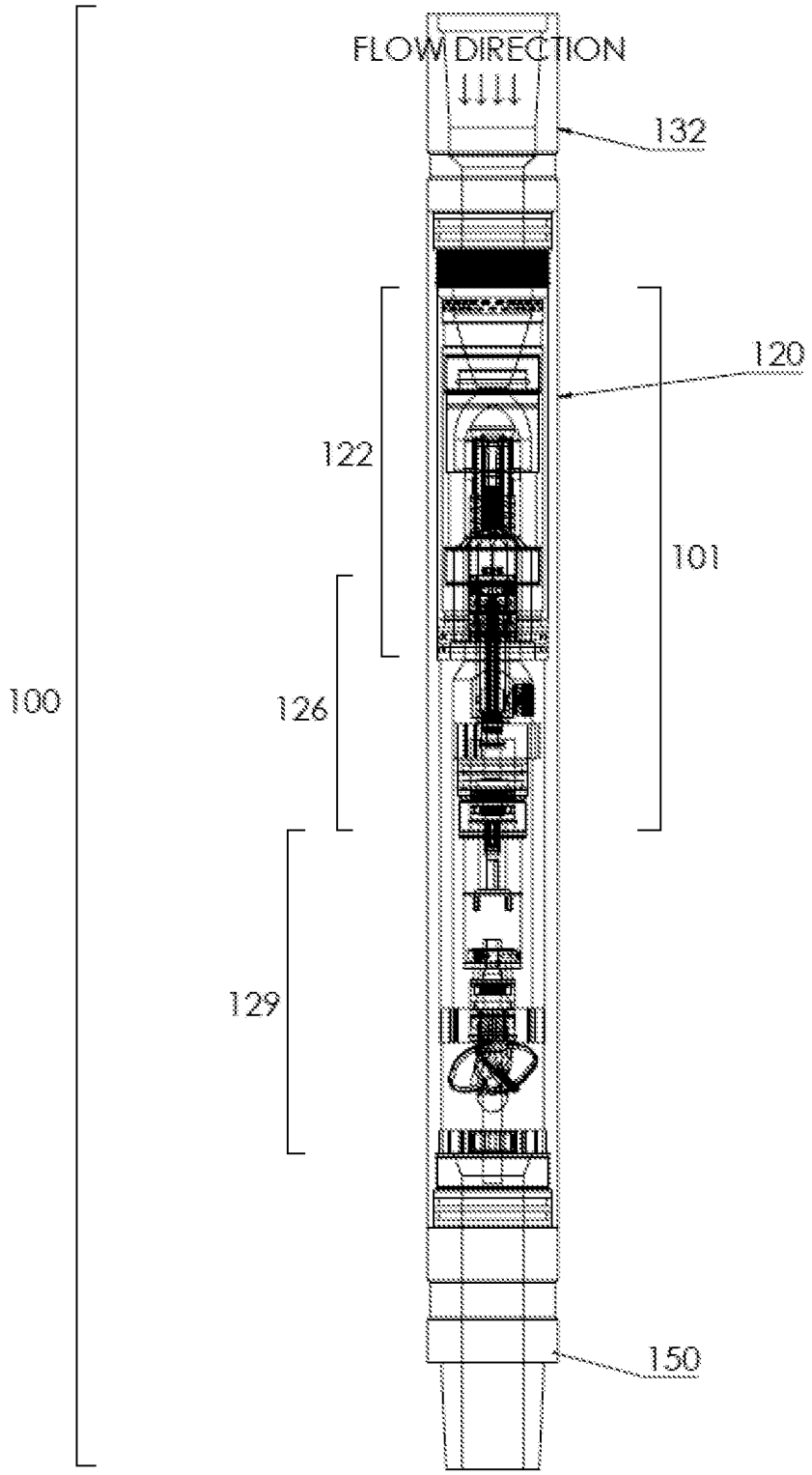
FIG. 1 provides a cross-sectional view of the tool.
Figure 4:
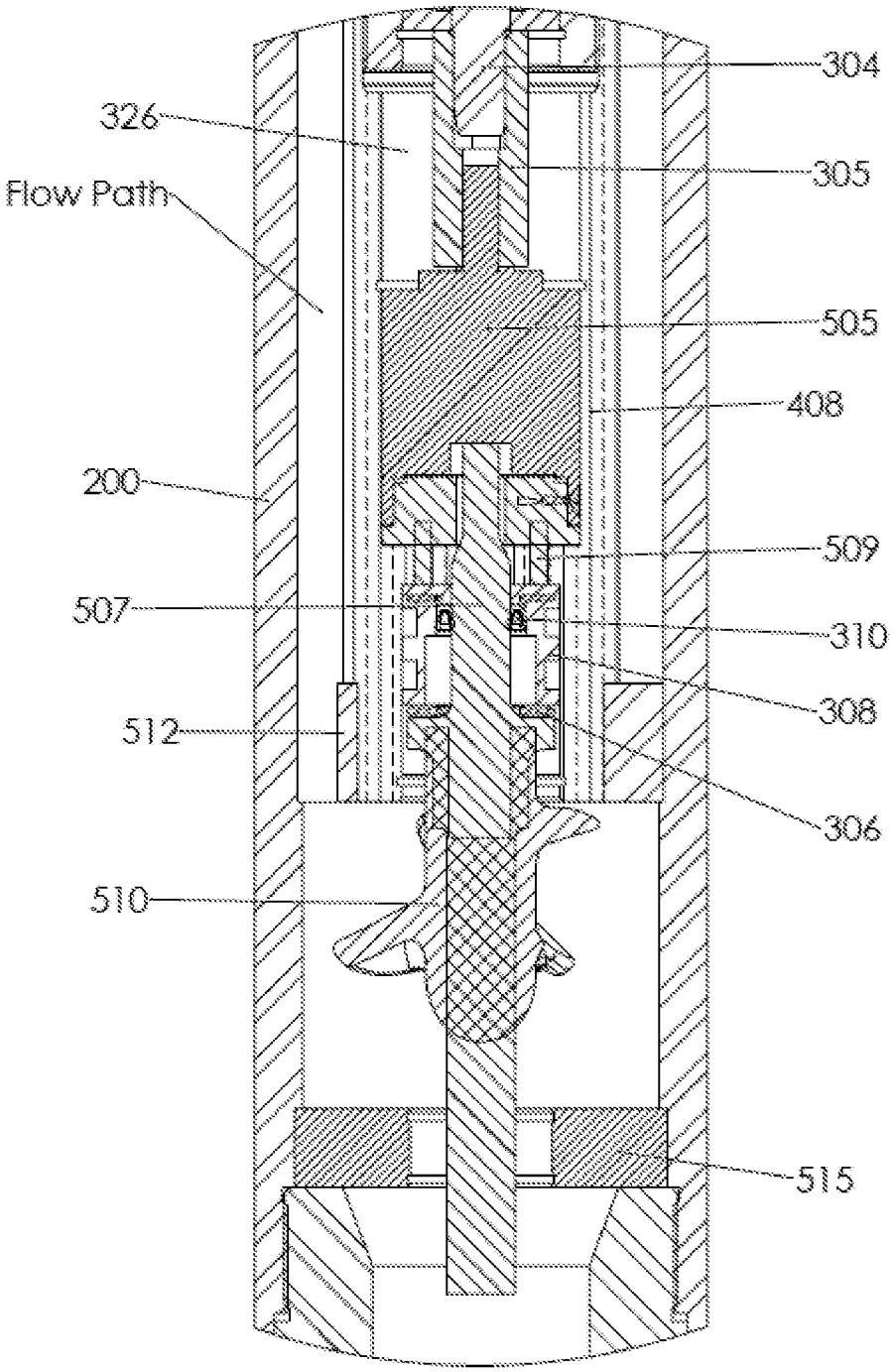
FIG. 4 is an illustrated view of the power/drive section of the tool.

FIG. 1 is a schematic that provides for a completed modular down-hole tool [100] in its entirety. The tool [100] has three major sections: the Pulser Section [101] that houses the main valve section [122], a pilot valve section [126], and an impeller section [129]. The fluid enters the tool at the top portion where the tool is connected to the coil tubing by the upper string connection [132] also referred to in the industry as a "top crossover connection". Respectively the fluid exits the tool at the bottom through the lower string connection [150], also referred to in the industry as a "bottom crossover connection", where the tool [100] is connected to the downhole motor or some form of a Bottom Hole Assembly (BHA) (not shown). The fluid flows through the tool on the inside of the upper pipe portion [120] in the opening around the pressure housing [408] (as shown in FIG. 4), and across the impeller [510] (as shown in FIG. 5).

Figure 2:
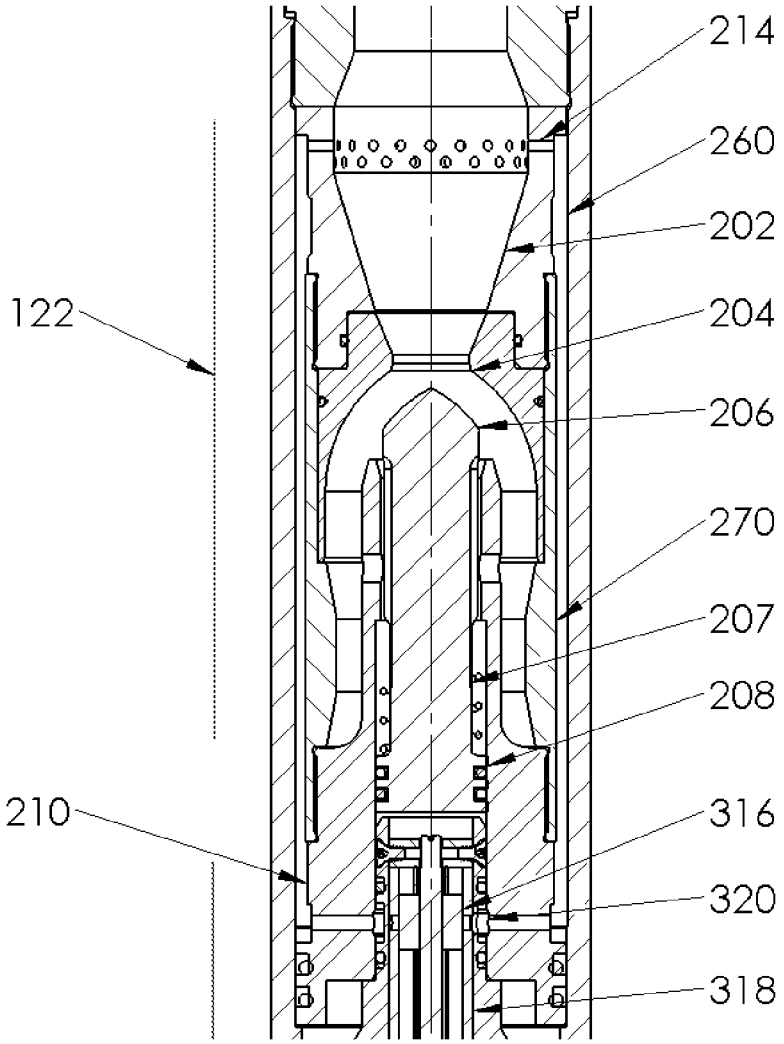
FIG. 2 is an enlarged cross-sectional view of the main valve section.

FIG. 2 shows the main valve portion [122] of the pulser section [101]. The fluid enters the tool through the upper string connection [132] into the Fluid Inlet Cone [202] and also through the Pilot Flow Take Off ports [214] into the Pilot Flow upper Annulus [260] to the Pilot Flow Inlet Channel [320], bypassing the Main Valve Orifice [204]. The Pilot Flow upper Annulus [260] is created by the concentric Pulser Pipe [270] inside the Upper Pipe Portion [120] connecting the Fluid Inlet Cone [202] with the Main Valve Housing [210]. Pilot Flow Take Off ports [214] are located along the circumferential area of the Flow Inlet Cone [202]. The main fluid flow in the center of the tool goes through the Main Valve Orifice [204] and around the Main Valve [206] in the open position, continuing around the internal parts of the entire Tool [100] until it exits through the Lower String Connection [150].

The Main Valve [206] in the closed position moves upward, or forward, into the Main Valve Orifice [204] restricting the main fluid flow and thus creating a backpressure in the fluid column upstream of the Main Valve Orifice [204]. The forward closing movement of the Main Valve [206] is activated by the pilot fluid which enters the Main Valve Housing [210] through the Pilot Flow Inlet Channel [320]. The Pilot Inlet Cam [316] in the open position allows the pilot fluid to enter the rear part of the Main Valve [206] and the higher pressure of the pilot fluid causes the Main Valve [206] to move forward against the Main Valve Orifice [204] which is smaller in diameter with less pressure across it. The Main Valve Plunger [208] provides a complete seal for the pilot fluid to allow full pressure to act on the Main Valve [206]. When the Pilot Inlet Cam [316] closes off the incoming pilot fluid to the rear of the Main Valve [206], the main fluid flow through the Main Valve Orifice [204] assisted by the Valve Spring [207] returns the Main Valve [206] to its rear, open position allowing the main fluid to flow through the tool.

Figure 3A:
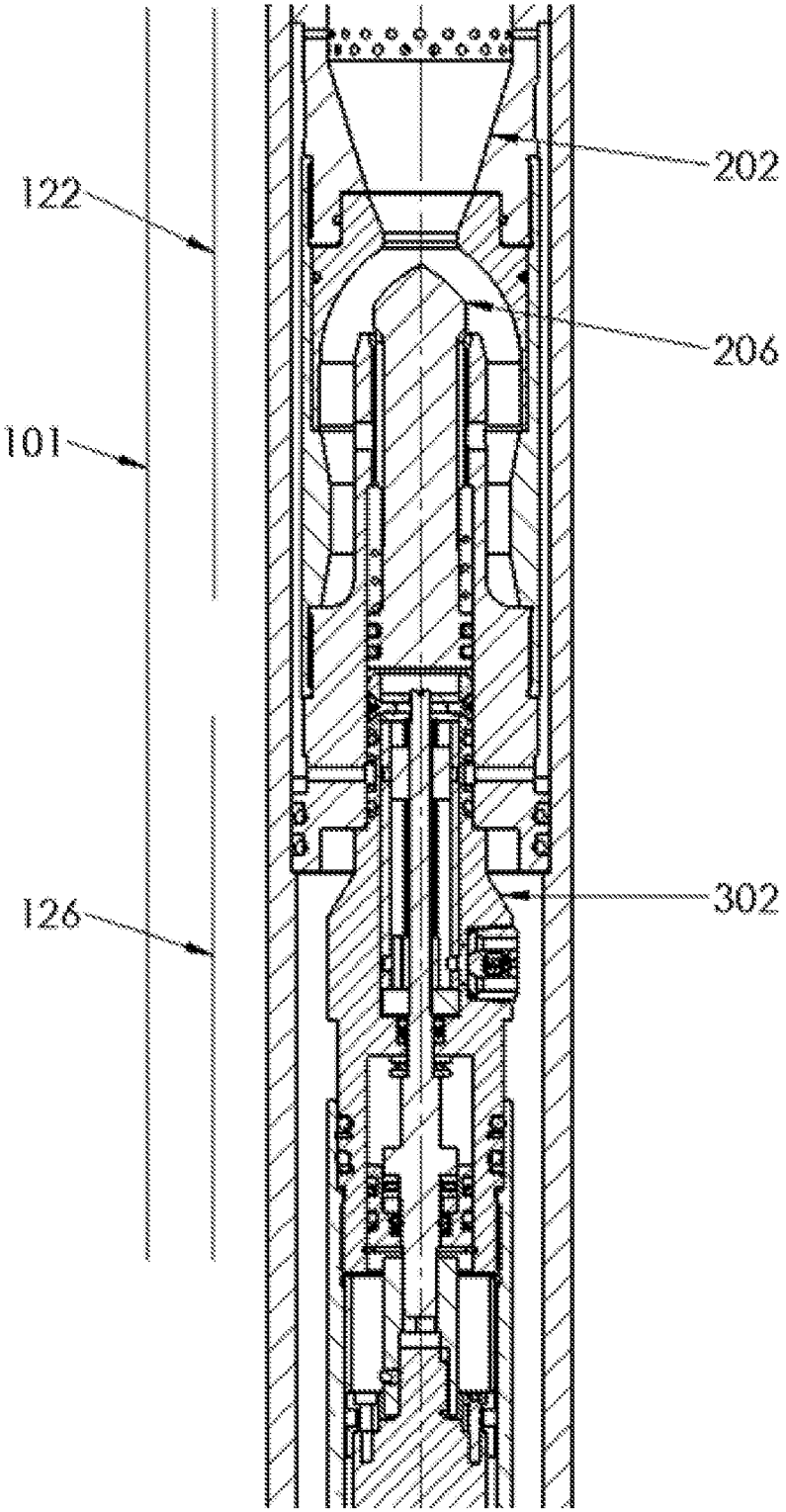
FIG. 3A is an enlarged cross-sectional view of the pilot valve section in relation to the main valve section.

FIG. 3A shows the Pulser Section [101] including the Main Valve Section [122] and the Pilot Valve Section [126] in relation to each other with their major internal components. The main fluid flow enters the Tool at the top into the Fluid Inlet Cone [202] and flows around the Main Valve [206] and around the Pilot Valve Housing [302].

Figure 3B:
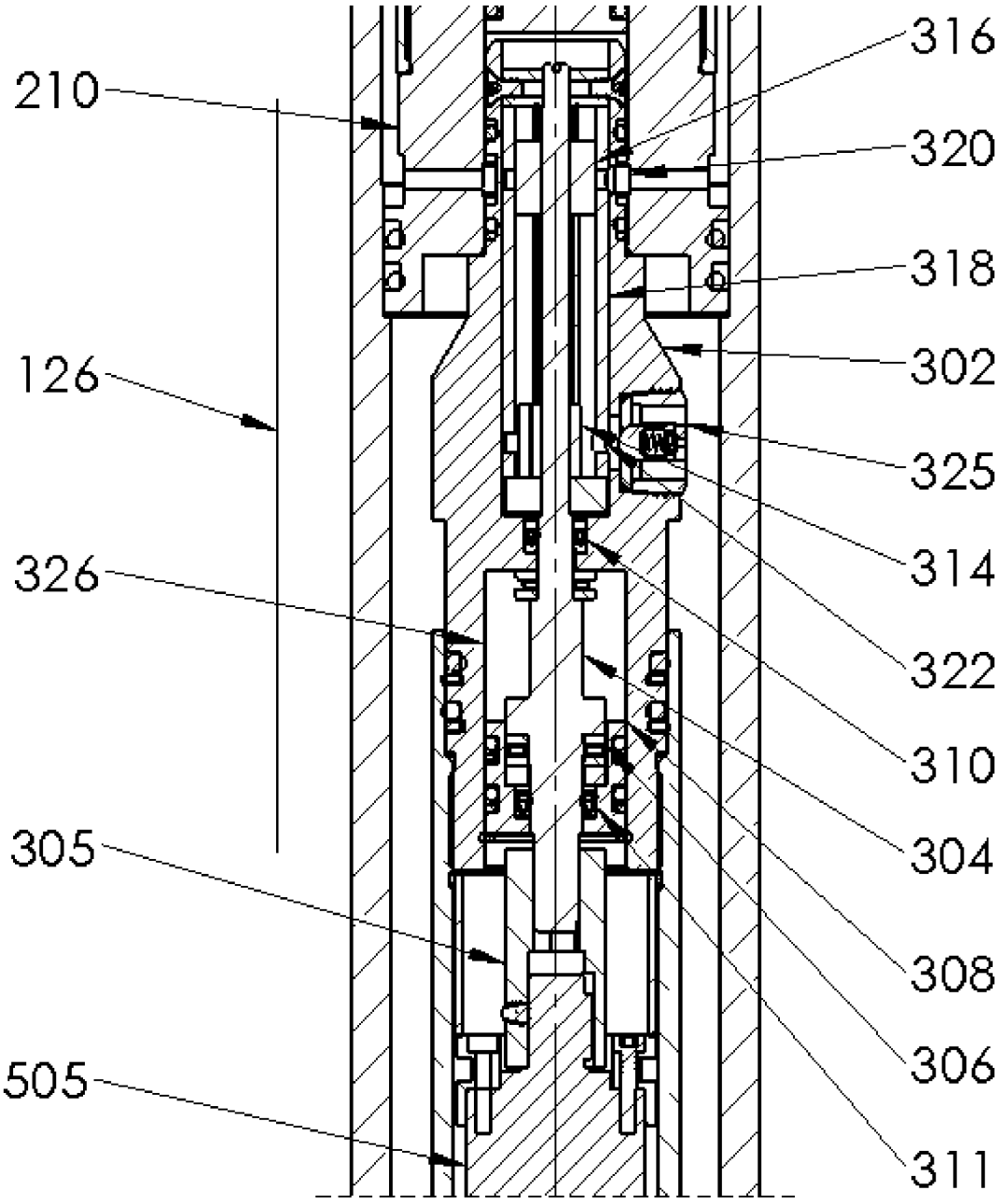
FIG. 3B is a more complete cross-sectional view of the pilot valve section.

FIG. 3B shows the Pilot Valve Section [126] of the Pulser Section [101]. The main fluid flows around the Pilot Valve Housing [302] inside the Upper Pipe Portion [120]. The Pilot Valve Section [126] consists of the Pilot Valve Housing

[302], the Pilot Shaft [304] which is positioned centrally and axially located and supported by Thrust Bearings [306], a Seal Carrier [308], Upper and Lower Rotary Seals [310, 311], and Pilot Inlet Cam [316] and Pilot Outlet Cam [314]. The Pilot Shaft [304] rotates the Pilot Inlet Cam [216] and the Pilot Outlet Cam [314] inside the Pilot Sleeve [318] which has matching holes to allow the pilot fluid flow to be controlled by the cams. The Upper and Lower Rotary Seals [310, 311] in the Oil Filled Chamber [326] separate the pilot fluid side above or in front of the upper Rotary Seal [310] from the air side below the lower Rotary Seal [311] housing the Drive Coupling [305], Gearbox [505] and below, thus preventing the pilot fluid from entering and damaging the Gearbox [505]. The Pilot Shaft [304] is rotated by the Gearbox [505] which is connected to it with a Drive Coupling [305]. The Pilot Inlet Cam [316] and the Pilot Outlet Cam [314] are positioned on the shaft rotationally so that when the Pilot Inlet Cam [316] is in open position it allows pilot fluid to enter the Main Valve [206]. At the same time the Pilot Outlet Cam [314] is in closed position preventing the fluid to exit through the Reverse Flow Check Valve [325]. The Impeller [507] rotates the Pilot Shaft [304] to position the Pilot Inlet Cam [316] to open and closed positions. When the Pilot Inlet Cam [316] is in closed position, the Pilot Outlet Cam [314] is in open position allowing the pilot fluid behind the Main Valve [206] to escape through the Reverse Flow Check Valve [325] to join the main fluid flow. The Reverse Flow Check Valve [325] allows the pilot fluid to exit the Main Valve [206] thus allowing it to return to the rear position away from the Main Valve Orifice [204]. Without the Reverse Flow Check Valve [325] in the case when the fluid may flow backward in the tool, the incoming fluid coming up from the lower part of the tool would enter the Pilot Flow Outlet Channel [322], which is an opening closed by a check valve, and would push the Main Valve [206] forward into the Main Valve Orifice [204] and thus blocking the fluid flow in the reverse direction through the tool. To prevent such case, the Reverse Flow Check Valve [325] prevents the fluid flow coming up the tool from below from entering the Pilot Flow Outlet Channel [322] to cause the Main Valve [206] to close to stop the fluid flow. With the Reverse Flow Check Valve [325] in place the tool can allow reverse fluid flow through the tool, although not pulsing the fluid, but still operating in normal pulsing mode in forward flow condition. The frequency of opening and closing the Pilot Inlet and Pilot Outlet Cams [316, 314] determines the frequency of the Main Valve [206] closing and opening and creating pressure pulses in the main fluid column in front of the Main Valve Orifice [204].

FIG. 4 shows the Impeller section [129] of the tool located in and below the Pressure Housing [408] inside the upper pipe portion [120], is downstream of the Pulser Section [101]. Fluid flows across the Impeller [510], which is mechanically connected to the impeller shaft [507]. The Impeller shaft is positioned centrally and axially located and supported by Thrust Bearings [306], a Seal Carrier [308], Rotary Seals [310], and gearbox [505]. The impeller shaft [507] transfers rotation from the impeller [510] to the gearbox [505] and Pilot Shaft [304] which drives the Main Valve [206] to create positive pressure pulses in the main fluid. The Gearbox [505] acts to convert the rotational speed of the Impeller [510] into the desired rotational speed (frequency) of the Pilot Shaft [304]. Anti-rotation pins [509] prevent the gearbox [505] from rotating freely inside of the pressure housing [408]. A centralizer [512] prevents and/or limits radial motion of the pressure housing [408]. An impeller shaft centralizer [515] prevents and or limits radial motion of the impeller [510] and impeller shaft [507].

We claim:

1. An apparatus for generating pressure pulses in a drilling fluid for a wellbore within a coiled tubing assembly comprising:

a valve longitudinally and axially positioned within a center of a main valve assembly, said main valve assembly including a main valve, wherein said main valve assembly also includes a main valve pressure chamber and a main valve orifice with said main valve, such that a drilling fluid stream splits into an inlet main fluid stream and a pilot fluid stream;

wherein said pilot fluid stream flows through a pilot flow annulus, and into a pilot inlet port, wherein a pilot fluid of said pilot fluid stream then flows past a pilot inlet cam behind said main valve which activates said main valve; and wherein a pilot fluid flows out through a pilot outlet so that said pilot fluid stream and said inlet main fluid stream are recombined to form a main flow that then passes around a drive coupling mechanism toward an impeller that enables a pulser to generate controllable, large, rapid pulses that provide for fluid that flows in, enhances and completes said wellbore.

2. The apparatus of claim 1, wherein both an upper rotary seal and a lower rotary seal exist within an oil filled pressure chamber and act to separate said pilot fluid stream so that said pilot fluid stream is located above or in front of said upper rotary seal, and so that a portion of said pilot fluid stream is exposed to atmospheric pressure, and wherein said portion of said pilot fluid stream also exists below or behind said lower rotary seal.

3. The apparatus of claim 2, wherein said drive coupling mechanism and a gearbox are connected and also exist below said upper and lower rotary seals which prevent said pilot fluid stream from entering and damaging said gearbox.

4. The apparatus of claim 3, wherein a pilot shaft is located within said impeller and is rotated by said impeller in order to convert linear fluid flow motion through said apparatus into rotational fluid flow motion, wherein said rotational fluid flow motion is transferred from said impeller to said gearbox via an impeller shaft.

5. The apparatus of claim 4, wherein said gearbox is connected to said drive coupling mechanism, and secures rotational motion with anti-rotation pins, and wherein said pilot inlet cam and a pilot outlet cam are positioned on said pilot shaft so that both cams can rotate, and so that when said pilot inlet cam is in an opened position, said pilot inlet cam allows said pilot fluid to enter said main valve, and simultaneously, said pilot outlet cam maintains a closed position that prevents said pilot fluid to exit through a reverse flow check valve.

6. The apparatus of claim 5, wherein said reverse flow check valve controls said pilot fluid stream that is allowed to escape from within a pilot housing during normal operation but prevents said pilot fluid of said pilot fluid stream flow in an opposite and/or reversed flow direction from a position outside of said pilot housing to a position behind said main valve such that a resultant reverse fluid flow direction does not cause pulsing of fluid while operation of a pulsing mode exists during a forward flow condition.

7. The apparatus of claim 5, wherein a frequency of opening and closing of said pilot inlet cam and said pilot outlet cam directly influences and determines one or more frequencies of a main valve opening and closing by creation of pressure pulses in a main fluid column above or in front of said main valve orifice.

8. The apparatus of claim 5, wherein said impeller shaft together with said gearbox rotates said pilot shaft in order to position said pilot inlet cam to either said opened position or a closed position, and wherein when said pilot inlet cam is in said closed position, said pilot outlet cam is in an opened position so that pilot fluid behind or below said main valve is allowed to escape through said reverse flow check valve and joins said main flow.

9. The apparatus of claim 5, wherein said reverse flow check valve allows said pilot fluid to exit said main valve so that said main valve can return to a rear or opened position with respect to said main valve orifice.

10. The apparatus of claim 1, wherein said apparatus is a tool.

11. A system that generates pressure pulses in a drilling fluid within a wellbore that exists within a coiled tubing assembly, said system comprising:

a tool within which exists a valve portion longitudinally and axially positioned within a center portion of a main valve assembly, said main valve assembly including a main valve, a main valve pressure chamber, and a main valve orifice within said main valve, such that as said drilling fluid flows downward in a drill string into said tool, said drilling fluid splits into an inlet main fluid stream and a pilot fluid stream, wherein said pilot fluid stream flows through a pilot flow annulus and into a pilot inlet port, wherein said pilot fluid stream then flows into a main valve fluid feed channel until said pilot fluid stream reaches said main valve pressure chamber and flows through a pilot valve section that functions as a pulser generating portion of said tool, wherein said tool further comprises a pilot valve housing, a pilot shaft positioned in a central axial position within said tool supported by thrust bearings, a seal carrier, upper and lower rotary seals, a pilot inlet cam and a pilot outlet cam such that said pilot shaft can rotate said pilot inlet cam and said pilot outlet cam inside a pilot sleeve with matching orifices so that said pilot fluid stream is controlled by movement of said pilot inlet cam and said pilot outlet cam, and wherein a pilot fluid flows into and through a pilot flow outlet channel such that said pilot fluid recombines with a main fluid flow to become a main exit fluid flow.

12. The system of claim 11, wherein a pilot valve actuator assembly is provided, wherein said pilot valve actuator assembly is any one or more from a group consisting of: said pilot valve housing, said pilot shaft, said upper and lower rotary seals, said seal carrier, said pilot cams, said pilot sleeve, an oil chamber, said thrust bearings and a reverse flow check valve.

13. The system of claim 12, wherein said thrust bearings reduce friction caused by an impeller and an impeller shaft that are connected to said pilot shaft that has said pilot cams attached to said pilot shaft and rotates said pilot cams.

14. The system of claim 13, wherein said pilot cams are sized and oriented within said pilot sleeve in order to allow for said pilot shaft to move in a rotary motion and in order to seal or open a pilot outlet port or a pilot inlet port.

15. The system of claim 11, wherein rotational motion of an impeller is caused by connection to a rotating pilot shaft that is connected to and moves said pilot cams which causes channeling of said pilot fluid toward said main valve.

16. The system of claim 15, wherein channeling of said pilot fluid causes said main valve to close and also allows for said pilot fluid to move said main valve.

17. The system of claim 16, wherein said pilot cams are sized and shaped in such a way that a portion of rotational motion blocks channeling of said pilot fluid toward said main valve and that cessation of said pilot fluid flow causes said main valve to open and also allows for said pilot fluid to exit said main valve.

18. The system of claim 17, wherein fluid pulses are generated by flow and cessation of said pilot fluid flow, and wherein said tool utilizes pilot shaft rotation that provides unidirectional rotary movement of said pilot shaft within said pilot valve housing.

19. The system of claim 17, wherein said tool provides a flow path allowing flow of said pilot fluid through a pilot valve that channels said pilot fluid toward said main valve resulting in bi-directional movement of said main valve along a moving axis during operation.

20. The system of claim 19, wherein a differential pressure of said drilling fluid is maximized with a flow cone inserted in a section of a main valve section, such that said flow cone provides for increasing velocity of said drilling fluid through an orifice of said section of said main valve section.

21. The system of claim 20, wherein increased velocity of said drilling fluid causes an increase in said differential pressure and also allows for utilization and better control of energy pulses created by opening and closing of said main valve ultimately controlled by said pilot valve.

22. The system of claim 21, wherein in a case such that no pilot fluid flows to rotate an impeller shaft, said impeller and connected pilot cams divert said pilot fluid that controls said main valve and avoids said main valve to remain in a closed stopped position, wherein a safety mechanism prevents said main valve from staying in said closed stopped position allowing said main fluid flow to start rotating said impeller.

23. The system of claim 11, wherein said tool includes three modular sections; a main valve section, said pilot valve section, and an impeller section.

24. The system of claim 11, wherein said tool exists within a Bottom Hole Assembly (BHA) above a down-hole positive displacement motor (PDM motor) during plug milling operations and provides allowance for ball drop-activated tools above said tool that can be operated in a normal fashion and without interruption.

25. The system of claim 11, wherein pulses are reliably transmitted in coil tubing strings to at least 30,000 ft.

26. The system of claim 11, wherein for annular frac applications, said tool provides reverse circulation capability in a screen-out event as a reverse flow check valve prevents a pilot valve from actuating said main valve in case flow in said drill string is reversed.

27. The system of claim 11, wherein said tool is a downhole tool that remains functional in the presence of hydrochloric (HCl) and hydrofluoric (HF) acids.

* * * * *